US006340864B1

(12) United States Patent
Wacyk

(10) Patent No.: US 6,340,864 B1
(45) Date of Patent: Jan. 22, 2002

(54) LIGHTING CONTROL SYSTEM INCLUDING A WIRELESS REMOTE SENSOR

(75) Inventor: Ihor T. Wacyk, Briarcliff Manor, NY (US)

(73) Assignee: Philips Electronics North America Corporation, New York, NY (US)

( * ) Notice: Subject to any disclaimer, the term of this patent is extended or adjusted under 35 U.S.C. 154(b) by 0 days.

(21) Appl. No.: 09/371,374

(22) Filed: Aug. 10, 1999

(51) Int. Cl.[7] ..... H05B 27/02

(52) U.S. Cl. ..... 315/158; 315/159; 315/DIG. 4

(58) Field of Search ..... 315/158, 149, 315/150, 152, 154, 155, 159, 267, 291, 294, 344, DIG. 4; 250/208.1, 332, 378, 214 AL, 214 LS, 215; 340/539, 565, 825.69, 825.72

(56) References Cited

U.S. PATENT DOCUMENTS 4,065,644 A 12/1977 Shinosky, Jr. ..... 179/18
5,181,025 A * 1/1993 Ferguson et al. ..... 340/870.21
5,237,169 A 8/1993 Grehant ..... 250/214
5,471,515 A * 11/1995 Fossum et al. ..... 377/60
5,489,827 A * 2/1996 Xia ..... 315/294
5,554,984 A * 9/1996 Shigenaga et al. ..... 340/937
5,648,656 A 7/1997 Begemann et al. ..... 250/214
5,837,994 A * 11/1998 Stam et al. ..... 250/208.1
5,841,126 A 11/1998 Fossum et al. ..... 250/208.1
5,869,857 A 2/1999 Chen ..... 257/292
5,973,594 A * 10/1999 Baldwin et al. ..... 340/506
5,990,469 A * 11/1999 Bechtel et al. ..... 250/208.1

FOREIGN PATENT DOCUMENTS

WO WO9724908 7/1997 ..... H05B/37/02

* cited by examiner

*Primary Examiner*—Don Wong
*Assistant Examiner*—Ephrem Alemu

(57) ABSTRACT

A system for controlling a light source including a wireless interface for communication with a remote sensor. The sensor is a low-power, integrated circuit device including functionality for detecting light from multiple directions or surfaces in an area, and for wireless communication. The sensor also includes functionality for detecting the presence of an occupant within the area.

26 Claims, 2 Drawing Sheets

LIGHTING CONTROL SYSTEM INCLUDING A WIRELESS REMOTE SENSOR

FIELD OF THE INVENTION

The present invention pertains generally to the field of lighting control. More particularly, the present invention relates to a lighting control system including a wireless, integrated circuit, sensor for detecting light and/or occupancy in an area.

BACKGROUND OF THE INVENTION

As is well known, fluorescent lamps offer large energy savings as compared to incandescent lamps. Additional energy savings can be obtained through the use of dimmable fluorescent lamp ballasts. These ballasts can be controlled by ballast control circuitry which reduces the level of the light produced by the fluorescent lamp. In this regard, conservation of energy is always an economic and environmental consideration in designing lighting systems.

In addition, as will be appreciated by one skilled in the art, the level and type of background illumination has a profound effect on the optimum artificial light needed for a work area. Besides the ergonomic aspects involved in providing adequate lighting, the light level in an area also affects the human physiology. It is well accepted that lighting can dramatically affect the circadian rhythm of the human physiological system. Accordingly, it is desirable to control the level of the artificial light to provide an optimum amount of light, see, e.g., U.S. Pat. Nos. 5,648,656 and 5,459,376, the contents of which are incorporated herein by reference.

Lighting systems are known that control, i.e., decrease or increase, the level of artificial light in relation to the level of daylight in an area. Generally, these conventional lighting control systems are hampered by the lack of adequate light sensors for flexible daylight harvesting applications. Typically, conventional sensor technology uses a single photodiode that senses the light on a work surface so that the light can be adjusted accordingly to maintain a constant value during the day.

Since such sensors detect light from either one limited position or possibly an averaged value over a predetermined area, it is necessary to carefully position and angle the sensors. This is required to ensure that the sensors detect adequate and accurate illumination data so that a desired light level can be provided throughout the day.

Furthermore, as will be appreciated by one skilled in the art, conventional sensor technology normally requires independent calibration for each application to achieve adequate results. One reason is that typical light sensors, for example, are analog devices that are prone to drift and inaccuracies.

In addition to the light sensors discussed above, separate motion sensors may also be used to detect the movement of an occupant in an area, as described in U.S. Pat. No. 5,489,827, the contents of which are incorporated herein by reference. A light source is turned "on" or "off" depending on the presence, or lack thereof, of an occupant in the sensing area. However, determining the state of occupancy within an area can be difficult depending on the positioning of the motion sensor. For example, the motion sensor's field of view may be limited or obstructed. Moreover, after placement of the motion sensor, subsequent rearrangement of an area's contents (e.g., furniture) may impair the field of view.

Another shortcoming of such motion sensors is that they are typically battery powered. Eventually, these batteries need to be replaced. This is not only inconvenient from a maintenance perspective, but the need for replacement may not always be readily apparent.

Conventional light and motion sensors also typically have wired connections to the control unit, e.g., ballast. This requirement adds extra cost for installation, as well as the extra cost for the wired interface in the control ballast, which must be isolated for safety reasons. These hard-wired sensors may be in addition to the need for a separate infrared (IR) sensor used by many ballast systems (e.g., Philips ballast systems) to provide a wireless control interface between the ballast and a handheld or wall mounted remote control unit. This IR sensor is usually mounted on the ceiling near the fixture with a wired connection to the ballast, which again adds to the overall system expense and installation time.

Some improvement in lighting control technology has been achieved by using multiple light sensors. In this arrangement, the sensors are tied to a control unit that generates a control signal based on the inputs from the multiple sensors. Illustratively, in the prior art, a ballast dimming signal based on some algorithm of multiple sensor inputs to control a light source is known. This type of arrangement, however, results in complex installation/setup procedures and expensive equipment requirements. Moreover, this arrangement fails to address the shortcomings of conventional sensor technology discussed above.

There thus exists in the art a need for a lighting control system that provides improved performance as well as reducing the cost, complexity and installation/setup time of the system. It is also desirable to provide a sensor that is not encumbered by hard-wired connections and limited-lifetime, power supplies.

BRIEF SUMMARY OF THE INVENTION

It is an object of the present invention to address the limitations of the conventional lighting control systems and sensor technology discussed above.

In one aspect of the present invention, a lighting control system includes a light source having a control unit and a wireless receiver. The system also includes a sensor having a plurality of pixels and a wireless transmitter, which are formed by a single integrated circuit (IC). The sensor transmits data to the light source using the wireless transmitter so that the control unit can control the light source in accordance with the transmitted data.

One advantageous embodiment of the present invention relates to the use of CMOS imaging technology for the sensor. This embodiment enables the integration of multiple functions into one integrated circuit (IC). This results in greatly reduced power requirements as compared to conventional sensors. The IC sensor architecture combines a wireless interface, as well as a pixel array for improved daylight harvesting and occupancy detection. The integration of these multiple functions into a single integrated component results in significant cost savings and reduced (installation/equipment) complexity for the lighting control system and sensor.

These and other embodiments and aspects of the present invention are exemplified in the following detailed disclosure.

BRIEF DESCRIPTION OF DRAWINGS

The features and advantages of the present invention can be understood by reference to the detailed description of the preferred embodiments set forth below taken with the drawings, in which.

DESCRIPTION OF THE PREFERRED EMBODIMENTS

Figure 1:
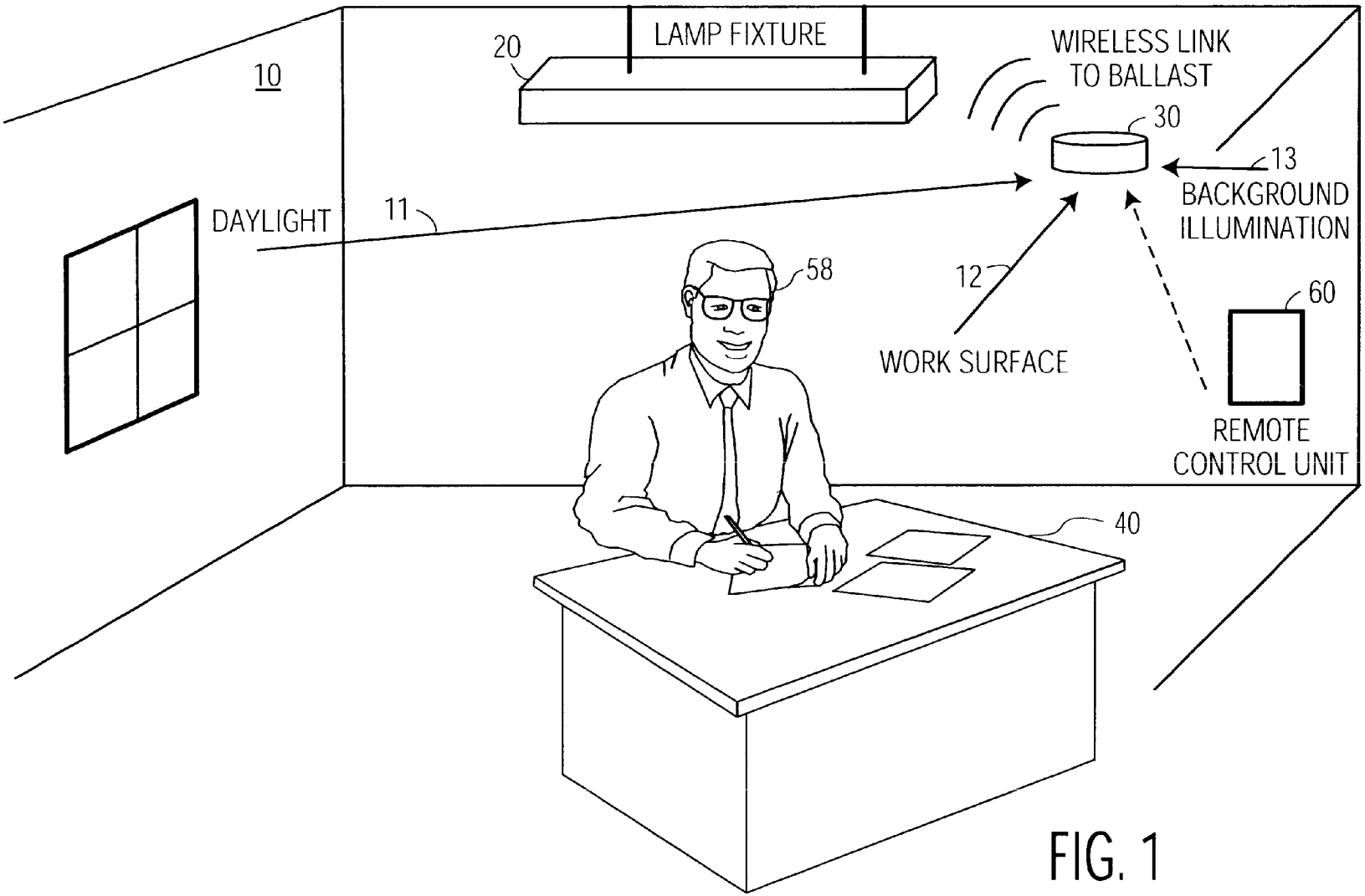
FIG. 1 is a diagrammatic view of a room in accordance with one aspect of the present invention.

Referring now to FIG. 1, an area such as a room 10 (a portion of which is shown) includes a luminaire, such as a lamp fixture 20, a sensor 30, a work surface 40, an occupant 50, and a remote control unit 60. The present invention of course is not limited to the office environment shown in FIG. 1, but may be used in any domestic environment or surrounding, such as buildings, sporting stadiums, aircraft or ships. It should also be understood that the lamp fixture 20 may be any controllable light source, such as a dimmable fluorescent lamp.

The sensor 30 is a standalone device that detects simultaneously illumination from various directions and surfaces in the room 10. This is done to obtain improved control and balance of the light level in the room 10 as compared to conventional lighting control methods that depend on sensing the light level using a single or multiple photodiode sensors.

Figure 2:
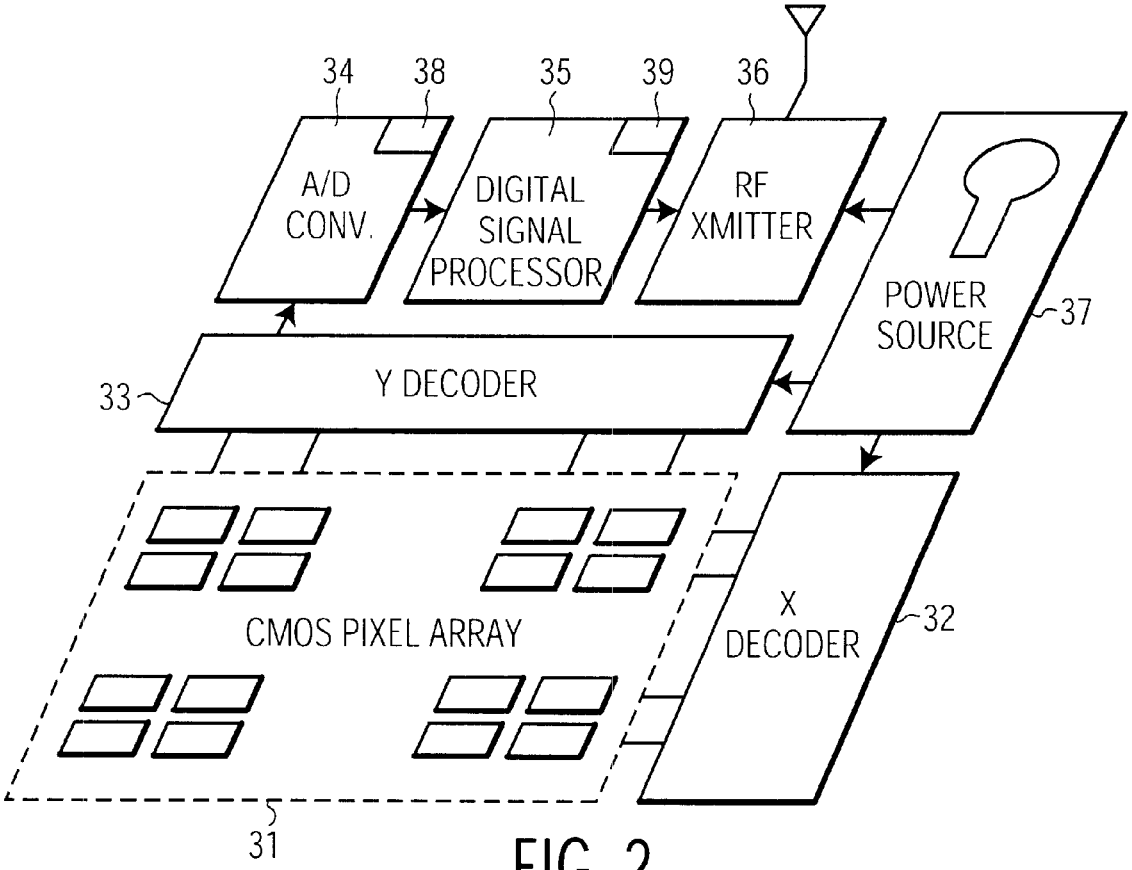
FIG. 2 is a schematic diagram showing details of a remote sensor in accordance with a preferred embodiment of the invention.

As shown in FIG. 2, the sensor 30 preferably comprises a CMOS pixel (imaging) array 31. The present invention, however, is not limited to CMOS technology. Other types of low power dissipating logic technology may be used. The sensor 30 also comprises X-decoder 32, Y-decoder 33, A/D converter 34, digital signal processor (DSP) 35, wireless transmitter 36 and a power source 37. In this embodiment, the pixel array 31 is arranged in rows (x-axis) and columns (y-axis). Of course, other pixel configurations are possible. X-decoder 32 and Y-decoder 33 are used to select a respective pixel from the array 31. The A/D converter 34 converts the analog data from a respective pixel to digital data in a manner well known in the art. The DSP 35 processes the digital data for transmission by the wireless transmitter 36. For a more detailed description of CMOS imaging sensors, the reader is referred to U.S. Pat. No. 5,841,126, the contents of which are incorporated herein by reference.

Compared to charged coupled devices (CCD) which are well known in the art, CMOS image sensors allow for integration of complex signal processing electronics on a single IC. This allow CMOS image sensors to have similar resolution while greatly reducing the power requirements as compared to CCD's.

For lighting applications, an optical resolution of several hundred pixels for the sensor 30 is preferred. Of course other resolutions may be used. For example, CMOS image sensors may have resolutions of tens to hundreds of thousands of pixels (primarily used for video and camera applications). But the preferred resolution results in significant size and cost advantages for the sensor 30. Moreover, as compared to conventional photodiode sensors which offer a resolution of one pixel, the sensor 30's resolution provides considerable improvement in the ability to sense illumination from various directions and surfaces in the room 10.

This resolution enables the sensor 30 to differentiate simultaneously light from various directions and sources in the room 10. This light may originate from, or be reflected from different sources or surfaces in the area. For example, as shown in FIG. 1, the sensor 30 detects light 11, 12 and 13 from the work surface 40, as well as from windows (i.e., daylight) and wall surfaces around the room 10 (i.e., background or ambient light). This information is collected by the sensor 30 so that an optimum level of artificial lighting for daylight harvesting can be determined as discussed below. Secondly, this resolution also allows the pixel array 31 of the sensor 30 to detect movement of the occupants in the room so that the sensor 30 can also be used as an occupancy detector.

In operation, the sensor 30 collects data in each pixel of the pixel array 31. This data is then converted into digital form by the A/D converter 34. The digital data is then processed/analyzed by the DSP 35 to extract key information, such as objects in motion, light levels from various sources and identification of specific features. This information is then formatted by the DSP 35 for transmission by the wireless transmitter 36.

The sensor 30 can be automatically calibrated through a digital circuit 38, e.g., included in the A/D converter 34, to eliminate analog errors such as drift and offset. The digital circuit 38 can also be programmed to adapt the sensor 30 to different environments and lighting conditions, resulting in rapid and trouble-free installation. In addition, the sensor 30 may have a plurality of predetermined environment settings and operational modes such as:

- Office-window (an Office with windows in which the ambient light may fluctuate greatly during the day);
- Office-no-window;
- Residential-kitchen (a residential kitchen in which bright light is required during the day, but, at night, only directional lighting is needed when an occupant is detected, i.e., providing a pathway to the refrigerator for the late-night snacker);
- Freq-Fast (a mode in which updated information is transmitted frequently to control/adjust the artificial light level in a rapidly changing environment);
- Freq-Slow;
- Light-Only (a mode in which only light levels are detected);
- Occupant-Only;
- Light-&-Occupant; and
- Night-On (a mode in which the lamp fixture 20 is automatically turn on when no daylight is detected or falls below a predetermined threshold level).

Figure 3:
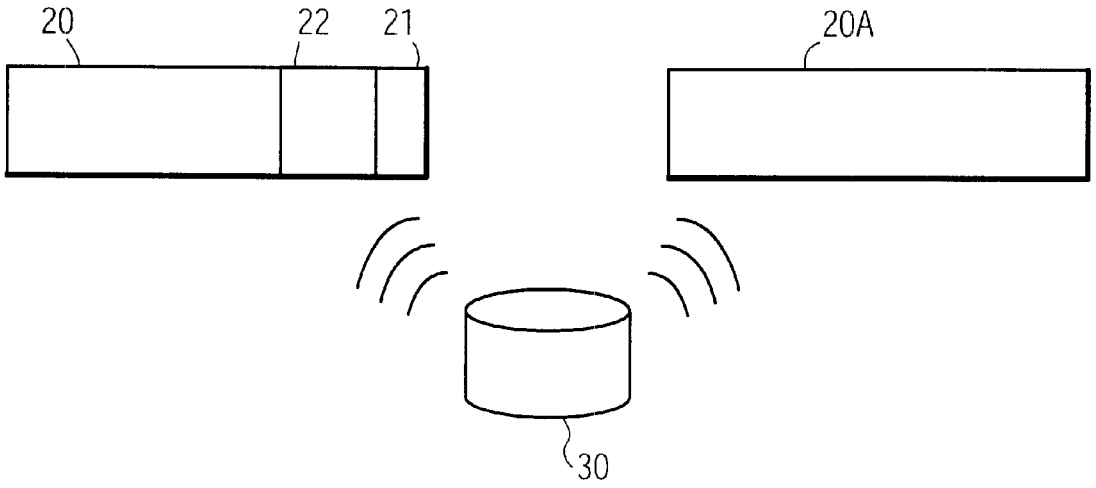
FIG. 3 is a block diagram showing a lighting control system in accordance with another aspect of the invention.

As shown in FIG. 3, the lamp fixture 20 includes a wireless interface 21 and a control unit 22. The information transmitted by the sensor 30 is received by the wireless interface 21. The control unit 22 then processes the information to derive the correct control information (e.g., reduction or augmentation of the light output) based on the room lighting levels and/or the presence of occupants.

As will be appreciated, algorithms (e.g., implemented by software or firmware) and hardware are used by, and/or incorporated in, the control unit 22 to process the information accordingly. The control unit 22 may include ballast control hardware and a microprocessor for executing such algorithms and functions.

The control unit 22 also processes the information received from the sensor 30 to interpret information transmitted by the sensor 30 in accordance with the various predetermined settings and modes. It is also understood that the environment and mode settings are not necessarily mutually exclusive. Different environment and mode settings may be used together to tailor the lighting control system as needed.

The information transmitted by the sensor is preferably in a compressed digital format. Various compression formats may be used as will be appreciated by one skilled in the art. Compression reduces the transmission power consumption of the sensor 30. In addition, the information is preferably transmitted at low data rate because such transmission can be performed reliably and using low-power. Preferably the peak transmission data rate is in the range of 10 Kbits/second or less.

As should be appreciated, the sensor 30 addresses the problem of wiring costs by incorporating the wireless transmitter 36. CMOS passive or active RF transmitters are known in the art and have been used for applications such as identification badges. Preferably, the wireless transmitter 36 is a low-power RF transmitter. A short range RF transmitter can operate reliably at a power level of one milliwatt or less. Moreover, if the data is transmitted in short bursts periodically (e.g., every second), then the low duty cycle can reduce the average RF power level to less than 100 microwatts. This type of RF transmitter will provide a short-range link (1–2 meters) between the sensor 30 and the lamp fixture 20. Of course, other types of wireless interfaces may be used rather than RF, such as IR or ultrasonic interfaces.

When using a low-power RF transmitter, the sensor 30 is placed in close proximity to the control unit 22. For example, by mounting the sensor 30 to the ceiling near the lamp fixture 20. The wireless communications link is then automatically established. No wiring or drilling holes in the ceiling is required. Moreover, system setup is quick and easy.

Also, in such a configuration, the sensor 30 is used to control only its neighbor lamp fixture 20. This allows for easy control of individual lighting in cellular light arrangements. In lighting fixtures in large office rooms, for example, this makes it possible to achieve good daylight harvesting by allowing the fixtures near the windows to respond separately from fixtures that are further removed from the windows. It also permits personalized light setting by the occupant 50, who may wish to control the illumination on the work surface differently when working on the computer or drafting a memorandum.

Alternatively, the sensor 30 may incorporate identification codes as part of each transmitted information packet. Other control/selection information can also be transmitted in the information packet. In this embodiment, the control unit 22 of the lamp fixture 20 only accepts information packets with a particular code. This enables the sensor 30 to control multiple lamp fixtures within an area individually. For example, as shown in FIG. 3, a second lamp fixture 20A also receives and decodes the transmission from the sensor 30.

The wireless interface to the lamp fixture 20 also results in design improvements and advantages in the control unit 22. A CMOS receiver can be easily integrated into a small low-cost IC, perhaps even as part of a main microcontroller IC of the lamp fixture 20 or control unit 22. Only access to a small and inexpensive antenna structure is needed.

At the same time, by using the wireless interface embodiment of the present invention, conventional two-wire interfaces typically used for control in fluorescent lamps, for example, can be eliminated. This two-wire interface is expensive because it must have high-voltage isolation for safety reasons, for example, typically a transformer or a dual optoisolator circuit is required. Accordingly, this embodiment provides significant cost savings in ballast design and reduces the physical size of the printed circuit (PC) boards required in such lamp fixtures.

In another embodiment of the present invention, the sensor 30 includes circuitry for a wireless receiver 39 (shown in FIG. 2). While a separate circuit block for the wireless receiver 39 may be used, it is preferable that the DSP 35 include this functionality. The wireless receiver 39 preferably functions as an infrared (IR) detector so that the lamp fixture 20 can be controlled using the handheld or wall mounted remote control unit 60. The use and popularity of these types of remote control units are increasing.

The DSP 35 can filter the IR signals from other optical signals detected by the pixel array 31. The pixel array 31 can detect both white light and IR signals with efficiency, so that a separate IR photo-detector deceive is not needed. Typically, IR signals modulate at a high frequency (e.g., 36 kHz from a typical television remote control device) and are digitally encoded. The DSP 35 can filter and decode this IR signal from slower varying white light signals.

Information based on the infrared signals from the remote control unit 60 is combined with other information that is transmitted to the control unit 22 by the sensor 30. As discussed above, the wireless interface eliminates the need for wiring and reduces installation costs, particularly for retrofit installations.

In another embodiment of the present invention, the sensor 30 functions as a passive device, or at least operates without a power-source such as batteries or a connection to an external power source. This can be achieved through the use of low-power CMOS circuit techniques. By performing the signal processing and data compression (discussed above) on the sensor 30, and using a low-power transmitter only for short periods of time, results in very low IC power requirements, e.g., power levels of less than a 100 microwatts. Since, the power requirements are so low, the sensor 30 can maintain operation via the power source 37 (shown in FIG. 2) using only electromagnetic radiation, i.e., "free" power, which emanates from ambient energy sources. For example, the free power can be obtained from either ambient light, or RF energy from a nearby ballast of the lamp fixture 20.

In yet another embodiment, the sensor 30 may received "free" power from ambient energy sources and also include a battery backup. In this embodiment, the power source 37 provides power to the sensor 30 to operate using the "free" power and/or the battery supplied power. This allows the sensor 30 to conserve the battery energy level by using the "free" power when possible.

While the present invention has been described above in terms of specific embodiments, it is to be understood that the invention is not intended to be confined or limited to the embodiments disclosed herein. On the contrary, the present invention is intended to cover various structures and modifications thereof included within the spirit and scope of the appended claims.

What is claimed is:

1. A lighting control system comprising:

a light source including a control unit and a wireless receiver; and a light sensor including a plurality of pixels and a wireless transmitter, which are formed by a single integrated circuit (IC), wherein said sensor being capable of transmitting data to said light source using the wireless transmitter.

2. A system according to claim 1, wherein the IC comprises CMOS technology.

3. A system according to claim 1, wherein said sensor also includes means, formed on the IC, for compressing the data before transmission by the wireless transmitter.

4. A system according to claim 1, wherein said sensor also includes means, formed on the IC, for detecting motion in a predetermined area.

5. A system according to claim 1, wherein said sensor also includes a wireless receiver formed on the IC.

6. A system according to claim 5, wherein the wireless receiver formed on the IC is an infrared receiver.

7. A system according to claim 1, wherein said sensor requires no more than 100 microwatts of energy to operate.

8. A system according to claim 1, wherein said sensor also includes means for receiving electromagnetic radiation from an ambient source, and wherein said sensor is to be powered at least in part by the received electromagnetic radiation.

9. A system according to claim 1, wherein the wireless transmitter is a radio frequency (RF) transmitter.

10. A system according to claim 1, wherein said sensor detects light from a plurality of directions or surfaces.

11. A system according to claim 10, wherein the transmitted data includes an identification code and information based upon the light detected by the plurality of pixels.

12. A system according to claim 10, wherein the control unit controls the light source in accordance with the transmitted data received from said sensor.

13. A system according to claim 1, wherein said sensor also includes means for setting at least one of a plurality of predetermined modes.

14. A light sensor for controlling an amount of illumination from a light source, said light sensor comprising a plurality of pixels and a wireless transmitter being formed by a single integrated circuit (IC), wherein the amount of illumination is increased or decreased in accordance with a control signal from said light sensor.

15. A sensor according to claim 14, wherein the IC comprises CMOS technology.

16. A sensor according to claim 14, further comprising means, formed on the IC, for compressing data to be transmitted by said wireless transmitter.

17. A sensor according to claim 14, further comprising means, formed on the IC, for detecting motion in a predetermined area.

18. A sensor according to claim 14, further comprising a wireless receiver formed on the IC.

19. A sensor according to claim 18, wherein said wireless receiver is an infrared receiver.

20. A sensor according to claim 14, wherein said sensor requires no more than 100 microwatts of energy to operate.

21. A sensor according to claim 14, further comprising means, formed on the IC, for receiving electromagnetic radiation from an ambient source, and wherein said sensor is to be powered at least in part by the received electromagnetic radiation.

22. A sensor according to claim 14, wherein said wireless transmitter is a radio frequency (RF) transmitter.

23. A sensor according to claim 14, wherein said sensor detects light from a plurality of directions or surfaces.

24. A sensor according to claim 22, further comprising means, formed on the IC, for setting at least one of a plurality of predetermined modes.

25. A method for controlling a light source comprising the steps of:

detecting a plurality of light signals from a plurality of directions using a single light sensor, including a plurality of pixels the light sensor differentiates a respective light signal from the plurality of light signals;

sending a control signal to the light source; and adjusting an amount of illumination from the light source in accordance with the control signal.

26. The method according to claim 25, further comprising the step of processing the plurality of light signals detected in said detecting step in accordance with at least one predetermined operational mode.

* * * * *